United States Patent [19]

Rausing

[11] 4,109,814

[45] Aug. 29, 1978

[54] CONTAINER CLOSURE

[75] Inventor: Hans A. Rausing, Lund, Sweden

[73] Assignee: AB Ziristor, Lund, Sweden

[21] Appl. No.: 739,788

[22] Filed: Nov. 8, 1976

[30] Foreign Application Priority Data

Nov. 19, 1975 [SE] Sweden ..... 7512983

[51] Int. Cl.[2] ..... B65D 55/02

[52] U.S. Cl. ..... 215/217; 215/253; 215/258; 215/306

[58] Field of Search ..... 215/217, 253, 258, 306

[56] References Cited

U.S. PATENT DOCUMENTS

| | | | |
|---|---|---|---|
| 2,752,060 | 6/1956 | Martin | 215/217 |
| 3,679,084 | 7/1972 | Aronson | 215/217 |
| 3,771,681 | 11/1973 | Mart | 215/217 |
| 3,944,102 | 3/1976 | Grau | 215/217 |

*Primary Examiner*—Ro E. Hart

*Attorney, Agent, or Firm*—Burns, Doane, Swecker & Mathis

[57] ABSTRACT

A container closure with a screw cap that after the opening of the container remains attached to the same, by means of a hinge. A sealing ring is joined to the lower end of the cap and rotatably connected to the container, but impossible to remove, as the inner diameter of the ring is smaller than the outer diameter of a bulge on the container. Between the cap and the sealing ring is a breakable connection and an unbreakable part serving as the hinge. When the cap is unscrewed the sealing ring is after a while obstructed by the bulge, which causes the breakable connection to break, whereafter the unscrewed cap can be swung aside around the hinge so that the contents of the container can be freely poured out.

3 Claims, 1 Drawing Figure

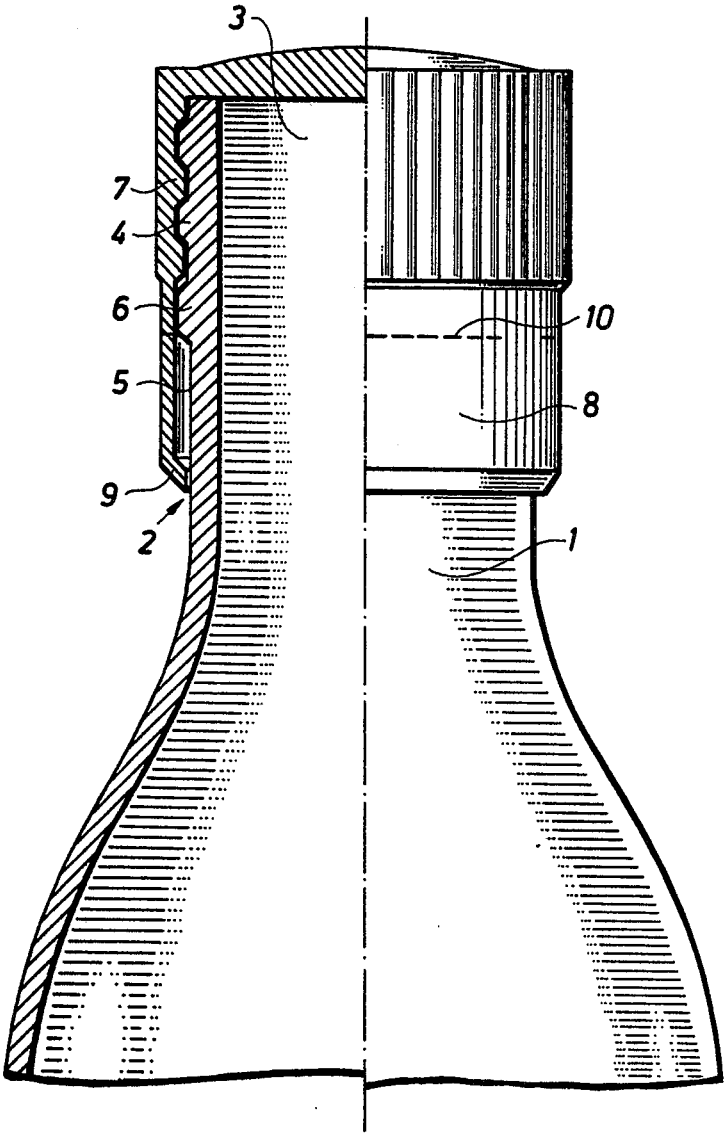
3
7
4
6
5
9
2
10
8
1

CONTAINER CLOSURE

The present invention relates to a container closure comprising a neck part provided with an outside screw thread portion and a pouring opening together with a screw cap closing the pouring opening.

Openable packing containers of the type which are used for the packing of e.g. liquid foodstuffs, that is to say bottles for beer and refreshing beverages, are usually closed by means of caps of metal or plastics which, when the bottle is to be opened, are either screwed off or prized open along any weakening line punched into the material. All the types of caps used at present have in common that after unscrewing or prizing up they are wholly detached from the packing container, that is to say that after the opening of the packing container, they are not in any way connected with the same. This separation of the packing components is a disadvantage is cases where it is desired to re-close the packing container. In recent times it has also been observed that this is a disadvantage from an environmental and nature preserving point of view, since it is found that the detached caps are often thrown away in the countryside. It is generally desirable therefore to design container closures in such a manner that the caps, also after the opening of the container, remain attached to the same.

A cap of such properties can be achieved fairly simple if the cap is of the snap or pressure type, since in these cases the removable cap parts can be fixed to the container by means, e.g. of a flexible strip or to a fixing ring arranged around the container neck. In conventional screw closures of the type which comprises a metal cap with inside screw thread co-operating with an outside screw thread on the container neck, however, the problem is more difficult to solve, since a retaining strip of the said type here on the one hand creates sealing problems when the top part of the cap is to be screwed on, and on the other hand represents an obstacle when the cap is to be screwed off.

It is an object of the present invention to provide a container closure of the type described at the beginning, which is not subject to the abovementioned disadvantages.

It is a further object of the present invention to provide a container closure of the abovementioned type which is simple to manufacture and which indicates whether the packing container has previously been opened.

These and other objects have been achieved in accordance with the invention in that a container closure comprising a neck part provided with an outside threaded part and a pouring opening together with a screw cap closing the pouring opening had been given the characteristic, that the neck part has an annular bulge situated below the threaded portion, that the screw cap is joined to a substantially cylindrical sealing ring which at its free end has an inwardly directed flange whose inside diameter is smaller than the outside diameter of the bulge, and that a kerf extending around the greater part of the periphery of the cap is arranged between the part of the cap provided with screw thread and the sealing ring.

Preferred embodiments of the container closure in accordance with the invention have been given the characteristics which are evident from the subsidiary claims.

A container closure manufactured in accordance with the claims has a number of advantages. Beside the advantage discussed already, that the part of the cap which can be screwed off the pouring opening remains attached to the packing container, a clearly visual indication is also obtained as to whether the packing container has previously been opened, since the kerf arranged between the screw-off cap and the sealing ring will then be broken. Moreover, the container closure can easily be opened since the mutual proportions of the container closure are chosen so that the kerf breaks automatically during the screwing off of the cap. Finally, the opening as well as the manufacture are facilitated by the absence of the aforementioned, often separately manufactured, strip for the retaining of the cap on the packing container.

The invention will now be described in detail with reference to the attached drawing, which shows schematically a container closure in accordance with the invention.

On the drawing is shown the upper part of a bottle 1 which is provided with a neck portion 2 and a pouring opening 3. The upper end of the neck part 2 situated close to the pouring opening 3 has a threaded part 4 which at its end towards the main part of the bottle 1 is delimited from a cylindrical part 5 of the neck by means of an annular bulge 6. The cylindrical part 5 of the neck part 2 is joined directly to the main part of the bottle 1 or bottle body.

The screw cap shown comprises an upper cap part provided with a thread 7 whose threaded portion corresponds to the threaded portion 4 of the bottleneck. The part of the cap provided with a thread 7 is manufactured in one piece and is joined to an annular fixed part or sealing ring 8, which is substantially cylindrical and has an inside diameter which corresponds to, or is a little greater than the outer diameter of the bulge 6. The bottom end of the sealing ring terminates with an inwards directed flange 9 whose inside diameter is smaller than the outside diameter of the bulge 6. The part of the cap provided with a thread 7 and the sealing ring 8 are delimited from one another by means of a kerf 10, extending around the greater part of the periphery, which is arranged at the same height as the bulge 6, and extends around 5/6ths of the circumference of the screw cap.

The relationship between the length of thread of the cap part 7 and the distance between the flange 9 of the sealing ring and the bulge 6 is relevant for the function of the cap. In a preferred embodiment the said relationship is 2:1, i.e. the length of thread of the cap part 7 is double the distance between the flange 9 and the bulge 6.

The container closure in accordance with the invention operates in the following manner. When the packing container or bottle 1 is unopened, the screw cap consisting of the upper part of the cap provided with a thread 7 and the sealing ring 8 are in the position shown on the drawing. Thus the upper surface of the cap part 7 rests in conventional manner against the neck end and provides a tight closure of the pouring opening 3. The kerf 10 arranged between cap part 7 and sealing ring 8 is unbroken. When it is desired to open the bottle, the part of the cap provided with a thread 7 is gripped, which part is appropriately designed on its outside with some type of friction-increasing element, and the screwing off of the cap is started by twisting of the same. In the course of this, the cap will, with the help of the co-operating screw thread portions, be screwed upwards along the bottleneck, so that the tight seal between the neck end and the upper surface of the cap no longer exists. The sealing ring 8 will follow the upward rotating movement without hindrance, since its inwards directed flange 9 can freely pass the cylindrical neck part 5. When the cap has been screwed off to approximately half its length of thread, however, the inwards directed flange 9 of the sealing ring 8 will come to rest against the underside of the bulge 6. On continued unscrewing of the cap, the sealing ring can no longer follow upwards, but the kerf 10, arranged between the sealing ring and the part of the cap provided with a thread 7, will now successively be broken. At the same time as the part of the cap provided with a thread is completely screwed off the threaded portion 4 of the bottleneck, the kerf has been broken over its whole length and the cap part 7 is now joined to the sealing ring 8 only via the part which exists between the two end parts of the kerf 10. The freed cap part 7 can now be folded towards the side without hindrance, and without the joint with the sealing ring 8 being broken. After pouring out of the desired quantity of contents, the part of the cap 7 can be folded back over the pouring opening and be screwed down, the sealing ring being displaced downwards again along the cylindrical part of the neck 5.

The screw cap in accordance with the invention can be machine-made in a simple manner, in one piece, from various different materials, e.g. metal or plastics. The cap can be applied to containers of different types, e.g. bottles, in automaic closing machines of known types.

Certain modifications of the form of the container closure may become necessary depending upon which material is to be used. The mutual relationship between the length of the threaded part and the distance between the flange and the bulge must be adapted to the cap material, and likewise the design of the kerf must be adapted to the material.

I claim:

1. A closure for a container having a neck portion provided with a pouring opening and with outer screw threads about and an annular outwardly projecting bulge at the lower end of the screw threads, said closure comprising a cap member having an upper internally threaded portion for engagement with the screw threads of the neck portion of the container and a cylindrical sealing portion therebelow, the inner diameter of the cylindrical sealing portion being not less than the outer diameter of the annular bulge of the neck portion of the container and further having an inwardly directed annular flange at the lower end of the cylindrical portion, the inner diameter of the flange being less than the outer diameter of the annular bulge of the neck portion of the container, the length of the upper threaded portion of said cap member being greater than the length of the cylindrical sealing portion between the annular flange and the annular bulge of the neck portion of the container when said cap member is completely screwed onto the neck portion of the container, said cap member being further provided with a breakable kerf extending a major distance around the circumference thereof and disposed opposite the annular bulge of the neck portion of the container, whereby when said cap member is being unscrewed for opening the container, the annular flange abuts the annular bulge causing the breakable kerf to break leaving the upper threaded portion of said cap member attached to the cylindrical sealing portion thereof by that portion of said cap member between the two ends of the kerf.

2. A closure as claimed in claim 1, wherein the length of the upper threaded portion of said cap member is substantially twice the length of the cylindrical sealing portion between the annular flange of said cap member and the annular bulge on the neck of the container.

3. A closure as claimed in claim 1, wherein the breakable kerf extends substantially 5/6ths of the distance around the circumference of said cap member.

* * * * *